United States Patent [19]

Poulson

[11] Patent Number: 4,739,785

[45] Date of Patent: Apr. 26, 1988

[54] HUNTER'S CANOPY

[76] Inventor: George H. Poulson, 3810 Iroquois Ave., Erie, Pa. 16511

[21] Appl. No.: 936,627

[22] Filed: Dec. 1, 1986

[51] Int. Cl.[4] ..... E04H 15/58; E04H 15/04

[52] U.S. Cl. ..... 135/117; 135/90; 135/900

[58] Field of Search ..... 135/117, 120, 90, 95, 135/900, 901

[56] References Cited

U.S. PATENT DOCUMENTS

| | | | |
|---|---|---|---|
| 144,193 | 11/1873 | Elliott | 135/90 |
| 437,336 | 9/1890 | Giebel | 135/90 X |
| 795,619 | 7/1905 | Jones | 135/95 X |
| 2,897,002 | 7/1959 | Yovich | 135/90 X |
| 2,972,377 | 2/1961 | Jacobs | 135/90 X |
| 3,730,196 | 5/1973 | Borskey | 135/90 X |
| 3,902,264 | 9/1975 | Radig | 135/901 X |
| 4,433,699 | 2/1984 | Schultes et al. | 135/117 X |
| 4,505,286 | 3/1985 | Madion | 135/901 X |
| 4,526,307 | 7/1985 | Parker | 135/95 X |

*Primary Examiner*—Robert A. Hafer
*Assistant Examiner*—D. Neal Muir
*Attorney, Agent, or Firm*—Charles L. Lovercheck; Wayne L. Lovercheck; Dale R. Lovercheck

[57] ABSTRACT

A hunter's canopy is made up of a flexible cover, a bracket, spaced rods, an anchor cord, a spreading cord. Spaced pockets in the flexible cover receives the rods. Holes in the bracket receives an end of the rods, the anchor cord engages the bracket to attach the canopy to a tree. The spreading cord has hooks to attach to an edge of the cover around a tree to hold the canopy in extended use position.

14 Claims, 4 Drawing Sheets

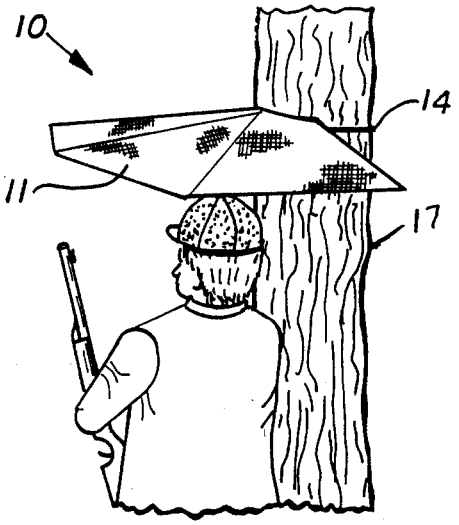
FIG. 1
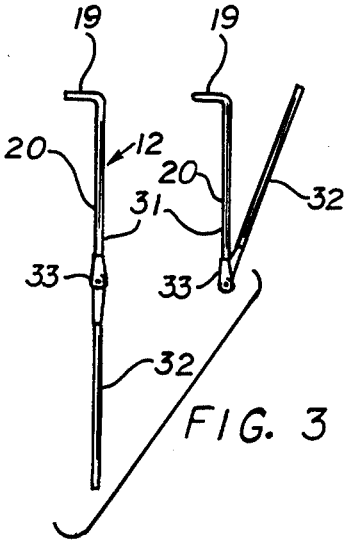
FIG. 3
FIG. 2
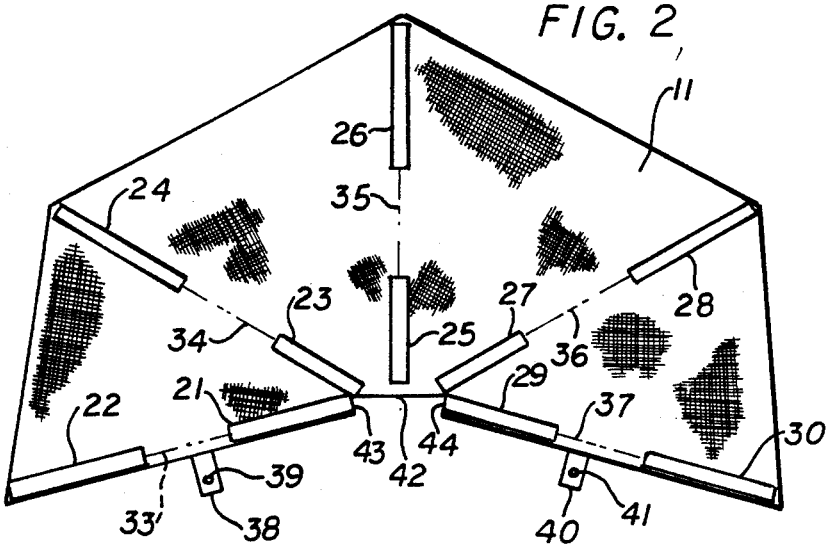
FIG. 4

HUNTER'S CANOPY

STATEMENT OF THE INVENTION

The hunter's canopy according to the invention is constructed specifically to require a minor amount of assembly work. The canopy is light weight and may be made of compact enough construction to be carried in a pouch no greater than ten (10) inches in length and no greater than a few inches in circumference which can be carried on a clip fastened to the hunter's belt.

The hunter's canopy is constructed of rigid rods or tubes which may be finished in a manner that the quarry is unable to see. The canopy when in use may have a slope of about 15° which is sufficient to allow normal run-off of rain but is less visible to the quarry. The support rods used in the canopy are simple in order to allow the hunter to easily repair a damaged support rod which may result from an accident during hunting. The canopy is specifically designed to attach to a tree by using a cord passing around the tree with a sliding lock that forms a loop which may be placed over a hook on the canopy and tightened. A sliding lock may also be used to retain the canopy in open position with proper tension. The hunter's canopy is specifically designed without any place on it on which the hunter can hang a gun. This is in the interest of safety as required by many state laws. The fabric can be quickly removed from the supporting rods to permit repairs to the fabric. The canopy has advantages over a simple modification of a commercial umbrella and is constructed to overcome many of the disadvantages of a simple umbrella.

REFERENCE TO PRIOR ART

U.S. Pat. Nos. 4,458,707 to Lindaman and 4,284,095 to Norton show hunter's canopies, which are basically commercial umbrellas. The Norton patent has a suspension bracket and the Lindaman patent has a part of one side removed and two ribs removed and the handle of the umbrella provided with a strap so that it can be tied to a tree.

Other references of prior art known to Applicant are U.S. Pat. Nos.: 1,520,719 to Pilkinton, 1,813,703 to Kattmann, 2,442,132 to Laythe, 3,156,497 to Lessard, 3,368,575 to Besonen, 3,783,906 to Matherne, 3,822,813 to Carter, 4,505,286 to Madion, 4,524,792 to Tzabanakis.

OBJECTS OF THE INVENTION

It is an object of the invention to provide a hunter's canopy constructed specifically to require a minor amount of assembly. It is light in weight and compact enough to be carried in a pouch about ten (10) inches long and three (3) inches in diameter which may be carried on a belt clip.

Another object of the invention is to provide a hunter's canopy specifically constructed of rigid rods or tubes (to maintain a low profile and minimize the amount of material visible to the quarry). The canopy has a slope of approximately 15° which is enough to allow for normal run-off of rain but is less visible to the quarry. The rods or tubes are specifically kept simple in order to allow the hunter to easily repair damaged support rods which may be the result of an unexpected accident.

Another object of the invention is to provide a hunter's canopy that is specifically designed to attach to a tree simply by using a cord that passes around the tree with a sliding lock that forms a loop which may be placed over a hook on the canopy and tightened by a sliding lock. A cord is also used to keep the canopy open with the tension desired by each individual hunter. Thumb screws or mechanical devices which are hard for the hunter to open due to cold hands which result in less ability to perform with precision are eliminated.

Another object of the invention is to provide a hunter's canopy especially designed free of any place for the hunter's gun to hang. In interest of safety, many state laws prohibit a loaded gun to be leaned or suspended.

Another object of the invention is to provide a hunter's canopy that is specifically designed with a fabric covering which can quickly be removed from the supporting rods to permit repairs of tears, etc.

Another object of the invention is to provide a hunter's canopy which has advantages over a simple modification of a commercial umbrella. The canopy has a low visibility profile and rigid construction to prevent movement by wind. In the take-down mode, the hunter's canopy is unique in that the support rods and the material can be easily repaired and replaced at minimum cost.

Another object of the invention is to provide a hunter's canopy that is more rugged in construction than a commerical umbrella and has all the desirable features of the previous modifications of a commercial umbrella used for hunter's canopies.

With the above and other objects in view, the present invention consists of the combination and arrangement of parts hereinafter more fully described, illustrated in the accompanying drawing and more particularly pointed out in the appended claims, it being understood that changes may be made in the form, size, proportions and minor details of construction without departing from the spirit or sacrificing any of the advantages of the invention.

BRIEF DESCRIPTION OF THE DRAWINGS

FIG. 1 is an isometric view of the hunter's canopy in use on a tree.

FIG. 2 is an enlarged view of one of the supporting rods for the canopy.

FIG. 3 is an isometric view of one of the ribs shown in the positions for supporting the canopy on a tree.

FIG. 4 is a bottom view of the flexible cover for the canopy in unfolded position.

DETAILED DESCRIPTION OF THE DRAWINGS

Figure 5:
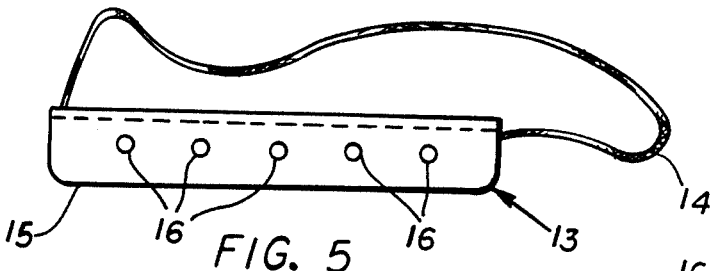
FIG. 5 shows a top view of the supporting bracket with the cord used to attach the bracket to a tree.
Figure 6:
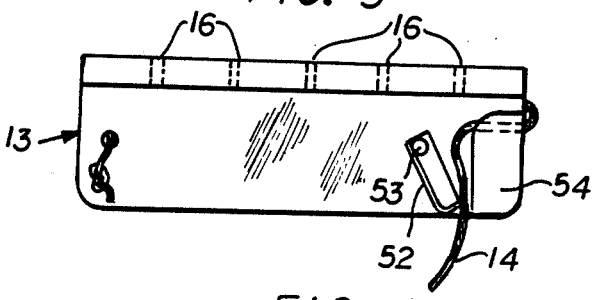
FIG. 6 is a front view of the bracket of FIG. 5.
Figure 7:
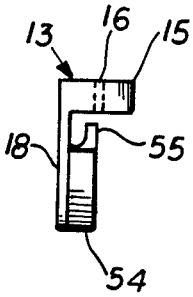
FIG. 7 is an end view of the bracket of FIGS. 5 and 6.
Figure 8:
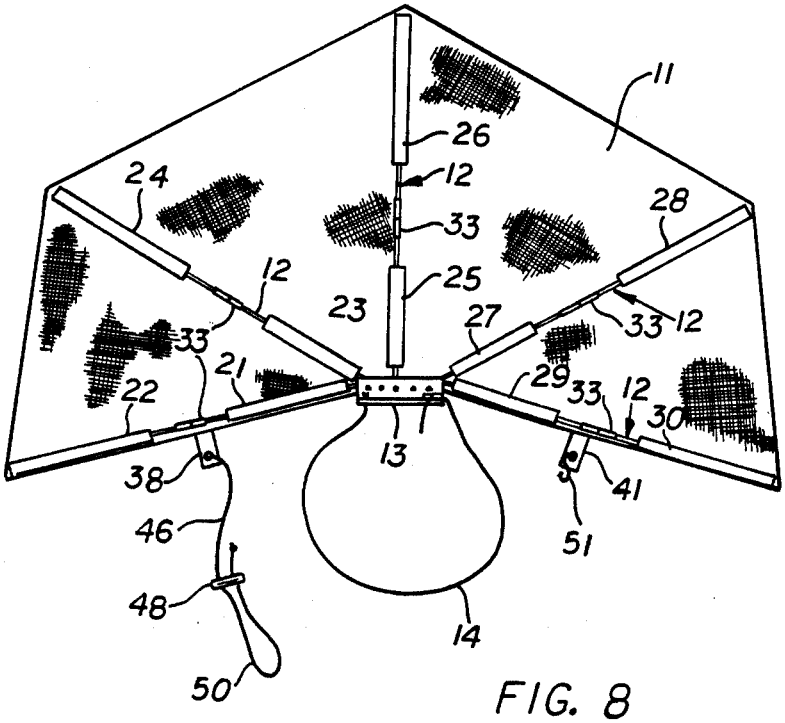
FIG. 8 is a bottom view of the canopy and bracket to be supported on a tree.

Now with more particular reference to the drawings, I show a hunter's canopy indicated generally at 10 made up of a flexible cover 11 and supporting rods 12 which may be attached to a tree by means of a bracket 13 extended and held in place by an anchor cord 14. The bracket 13 is an angular member which has a leg 15 and a web 18 disposed at a right angle to leg 15 with spaced holes 16. Web 18 rests against a tree 17 when the canopy is in use.

The five rods 12 each have an end part 19 bent generally at right angles to the body part 20 of the rod. The rods 12 may be made in the form of tubes and made of metal, wood or plastic. Each rod is made of two parts 31 and 32 which are held together by hinges 33. The rods 12 may be made in three parts, if desired. Three parts are preferred because the cover can be made sufficiently wide, yet the rods 12 may be folded to a compact size and shape. Hinges 33 have a stop on them and will fold in one direction only, that is from straight to folded position. The parts 31 and 32 of rods 12 are held to the hinges 33 by forcing an end into a hole in each part of the hinges 33. Hinges 33 are made by flattening the ends of the rods 12. Two flat side plates 36 and 37 sandwich the flattened rod ends between the plates 36 and 37. Pins 38 fasten the rods 12 to the plates 36 and 37. The flexible cover 11 has rod receiving pockets 21, 22, 23, 24, 25, 26, 27, 28, 29 and 30 sewed or otherwise attached to it to receive the body part 20 of each rod. A rectangle-shaped recess 42, having ends 43 and 44, is formed in flexible cover 11. The length of the side 42 is about equal to the length of the bracket 13 and the width of ends 44 and 43 are about equal to the width of the leg 15 of the bracket 13.

Figure 14:
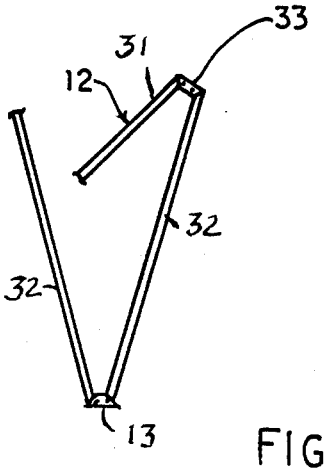
FIG. 14 is a partial side view of the hinge and arms of another embodiment of the invention incorporating a three arm arrangement of the support for the cover.

In the embodiment of the invention utilizing the three leg section of supporting rods 12 shown in FIG. 14, the cover is made larger and the frame will still be short enough in its folded position to fit into a hunting coat pocket. The frame has three rods 12 connected together by hinges 33 made up of side plates 36 and 37 which sandwich the flattened ends 34 between them. The ends 34 are flattened so that the inner surface of the flattened ends are inclined at an angle of about 30 degrees to the longitudinal axis of the rods so that the marginal edges 35 act as stops to limit the movement of the rods and thus hold the canopy in the desired position.

Figure 9:
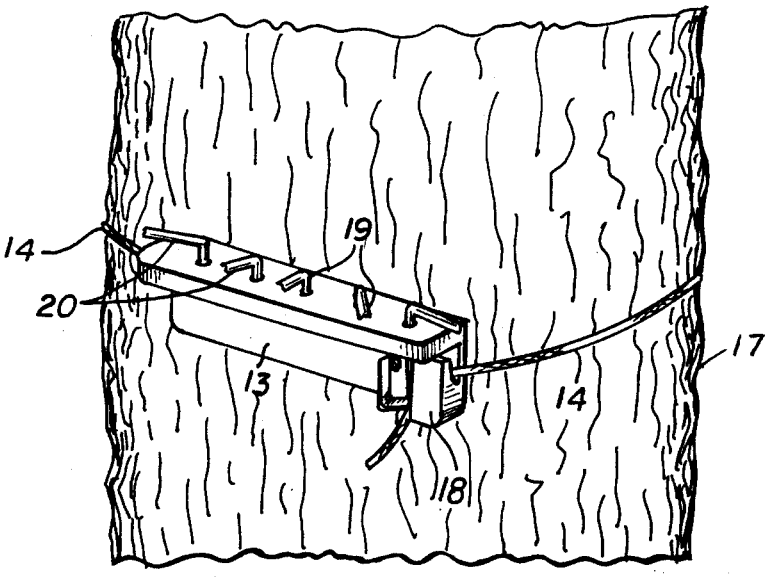
FIG. 9 is a front view of the bracket supported on a tree.

To mount the canopy on a tree, web 18 of the bracket 13 will first be placed against the trunk of a tree, as in FIG. 9, and an anchor cord 14 will be passed around the tree and fastened by cam lock 52, holding the bracket with its legs 15 extending outward from the tree.

Cam lock 52 is pivoted to bracket 13 at 53 and can swing to anchor cord 14 and the cord is cramped between the lock 52 and the flange 54. Flange 54 is fixed to bracket 13 and extends outward perpendicular to the bracket and has a notch which is defined by a finger 55 behind which anchor cord 14 can pass. The spreading cord 46 will then be fastened to the nylon tab 38 through hole 39 and the hook 51 will be hooked into the loop 50 of the spreading cord 46. The spreading cord that is fastened to the nylon tab 38 having a grommet in hole 39 will then be passed behind the tree 17 placing the loop 50 formed by tightening the dowel 48 on spreading cord 46, over the hook 51 provided on the opposite tab 41. The dowel 48 will then be slid until the cord is just sufficiently taut. The dowel 48 will then be angled to lock the spreading cord 46 in its position.

The tabs 38 and 41 are attached to the rear edges of the cover. Tabs 38 and 41 have holes 39 and 40 which may receive the cord 46 to hold the canopy spread in place. The five bents rods 12 will then have their ends 19 inserted through the holes 16 in leg 15. The body parts 20 of the rods will be inserted into pockets 21 through 30. The bracket leg 15 will be received in the recess 42 in the flexible cover 11.

The canopy can be quickly mounted on a tree by unwrapping the cords 14 and 46 from the folded cover, unfolding the rods 12 and the flexible over 11 to extended position, swinging the rods out, thereby extending the canopy, placing the bracket 13 against the tree trunk and securing the anchor cord 14 and locking it behind the lug defining the notch, securing spreading cord 46 around the tree trunk. The hunter may then post himself under the canopy and wait for the quarry. The entire procedure of erecting the canopy can be carried out and the canopy can be in place, ready for use, easily in less than a minute.

Figure 10:
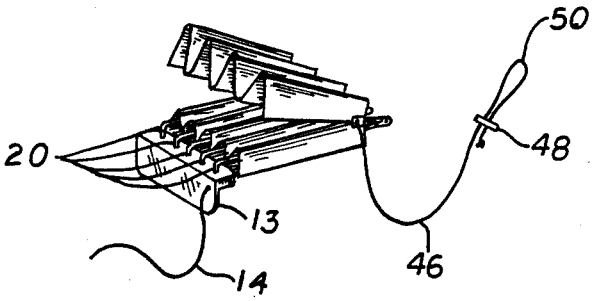
FIG. 10 is an isometric view of the canopy partly folded with rods, bracket and cords.
Figure 11:
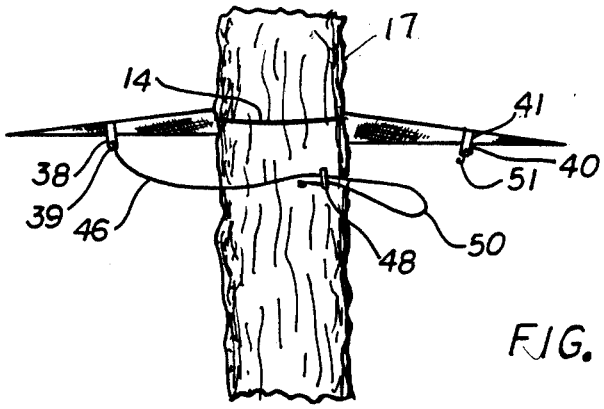
FIG. 11 is a rear view of the canopy supported on a tree showing three rods with cover extended in phantom lines.
Figure 13:
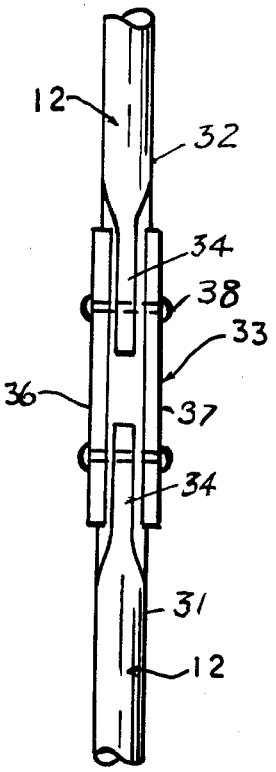
FIG. 13 is a partial side view of one of the rods in folded relation.
Figure 12:
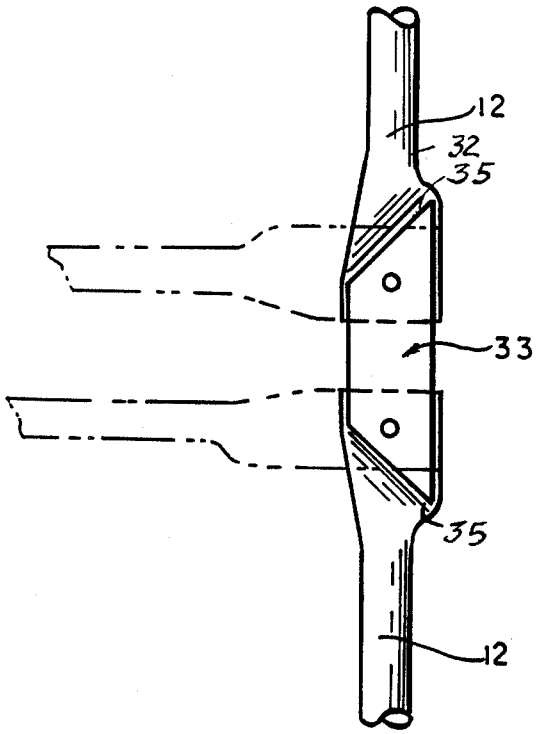
FIG. 12 is a partial enlarged top view of the hinge connection of one of the rods shown in phantom lines in folded relation.

The hunter's canopy can be folded by folding the flexible cover 11 with the rods 12, as shown in FIG. 10, withdrawing ends 19 from holes 16 and placing bracket 13 adjacent the folded canopy, wrapping the cords and flexible cover 11 around the rods and bracket 13 into a generally cylindrical bundle. In this mode, the folded canopy will be a package approximately ten (10) inches long with a circumference of a few inches. This is a convenient package to hang on the belt of a hunter.

The foregoing specification sets forth the invention in its preferred, practical forms but the structure shown is capable of modification within a range of equivalents without departing from the invention which is to be understood is broadly novel as is commensurate with the appended claims.

The embodiments of the invention in which an exclusive property or privilege is claimed are defined as follows:

1. A hunter's canopy comprising a flexible cover, an elongated bracket having ends and an intermediate part, means attached to said ends for attaching said bracket to a tree with said intermediate part of said bracket engaging said tree, said bracket having spaced holes extending therethrough, said flexible cover having a central recess generally complementary in shape to said bracket receiving said bracket, rods extending into said holes in said bracket to swingably attach said rods to said bracket, means on said flexible cover for receiving said rods, said flexible cover having tabs on the edge thereof adjacent to said recess and a spreading cord adapted to be tied to said tabs and around a tree to extend and to hold said flexible cover in laterally extended position.

2. The canopy recited in claim 1 wherein said rods have ends that are bent generally at right angles to said rods, said ends being adapted to be received in said bracket for holding said bracket in place.

3. The canopy recited in claim 2 wherein said rods extend generally radially from said tree and diverge from one another on said canopy holding said canopy in extended position.

4. The canopy recited in claim 1 wherein said rods are formed in two separate parts made up of a first rod and a second rod part, said first part and said second part of said rods connected together by a hinge, said hinge having a first stop means connected to a second stop means, said first rod part being pivotally attached to said first stop means, said second rod part being pivotally attached to said second stop means, said hinge stop means acting on said rod parts as said rod parts swing from a folded position to an unfolded position limiting said rod parts to an alignment with each other.

5. A hunter's canopy comprising a flexible cover, a bracket, canopy supporting rods, said bracket having a first leg and a second leg fixed together and extending at right angles to each other, laterally spaced holes in said first leg, each said canopy supporting rod having a main body part and an end disposed generally at right angles to said body part, radially extending pockets on said flexible cover, said flexible cover having a recess receiving said bracket, said pockets extending from said recess generally radiating therefrom, said end of each said canopy support rod being received in said holes in said first leg, said main part of each said rod extending through at least two of said pockets, said bracket having a first end, a second end and an intermediate part, said bracket having supporting means attached to said first end of said bracket for attaching said supporting means to said second end of said bracket whereby said intermediate part of said bracket is held against a tree.

6. The canopy recited in claim 5 wherein said flexible cover has means spaced from said recess for attaching a spreading cord thereto for holding said flexible cover in extended position.

7. The canopy recited in claim 5 wherein said means for attaching said bracket to said tree comprises an anchor cord attached to said first end of said bracket, fastening means adjacent said second end of said bracket, said anchor cord being disposed around said tree and attached to said fastening means.

8. The canopy recited in claim 7 wherein said rods are each formed in three separate parts connected by hinges, each said hinge is formed with a stop to limit the swinging movement of said parts relative to one another when said canopy is unfolded.

9. The canopy recited in claim 7 wherein each said hinge comprises a first part and a second part, each rod, being in the form of a tube, having a first flattened end and a second flattened end, each said hinge being pivotally connected to a rod adjacent said first mentioned rod, each said hinge comprising a first plate and a second plate with said flattened ends adjacent thereto, said rod ends being sandwiched between said plates and pivoted to each said flattend end.

10. The canopy recited in claim 8 wherein said attaching means comprises a flange fixed to said bracket, an outwardly directed flange member with a notch having a finger defining said notch fixed to said bracket, a cam lock pivoted to said bracket and swingable toward said finger and adapted to clamp said anchor cord between said cam and said finger.

11. The canopy recited in claim 8 wherein a spreading cord is attached to said flexible cover at a position spaced from said recess, said spreading cord having a first end and a second end, means to attach said spreading cord to said flexible cover at a position spaced from said recess at the opposite side thereof from said first end of said spreading cord.

12. The canopy recited in claim 9 wherein said means for fastening said second end of said spreading cord to said flexible cover comprises a hook attached to said flexible cover.

13. The canopy recited in claim 10 wherein said second end of said spreading cord comprises a generally cylindrical member having two axially spaced diametrically extending first holes and second holes therein, said second end of said spreading cord extending through said first hole and said second hole providing an adjustment.

14. A hunter's canopy comprising a bracket, first rods and second rods, a flexible cover, an anchor cord having a first end and a second end, a spreading cord, said flexible cover having two ends and a plurality of pockets diverging from one side thereof, said rods being received in said pockets, said bracket having a plurality of vertically extending openings therein and each opening to receive one of said first rods, hinges, said hinges each having a first part fixed to a said first rod and a second part fixed to a said second rod, pivot means pivotally connecting said hinge parts together whereby each said first rod can swing from a position parallel to and alongside a said second rod to a position co-axially disposed relative to a said second rod, said first end of said anchor cord being fixed to one end of said bracket and said second end of said anchor cord to attach to a second end of said bracket, means on said bracket for attaching said second end of said anchor cord to said bracket whereby said bracket is held in firm fixed relation to a tree trunk, said spreading cord having a first end and a second end, first fixing means fixing said first end of said spreading cord to said flexible cover at a position spaced from said bracket, adjustable means for adjustably connecting said second end of said spreading cord to said flexible cover at a position on the side of said bracket remote from said first end of said spreading cord, said spreading cord being adapted to pass around said tree trunk from said first end of said bracket to said second end of said bracket whereby said flexible cover is held in extended relation to said tree trunk with said rods in said pockets diverging from said bracket outwardly to an opposite side of said flexible cover supporting said flexible cover.

* * * * *